US008100495B2

(12) United States Patent
Kim

(10) Patent No.: US 8,100,495 B2
(45) Date of Patent: Jan. 24, 2012

(54) INKJET PRINTHEAD

(75) Inventor: Min-Soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 355 days.

(21) Appl. No.: 12/407,807

(22) Filed: Mar. 20, 2009

(65) Prior Publication Data

US 2010/0060687 A1 Mar. 11, 2010

(30) Foreign Application Priority Data

Sep. 9, 2008 (KR) ..... 10-2008-0088946

(51) Int. Cl.
*B41J 29/38* (2006.01)

(52) U.S. Cl. ..... 347/14; 347/20; 347/23; 347/84; 347/85

(58) Field of Classification Search ..... 347/14, 347/20, 23, 84, 85
See application file for complete search history.

(56) References Cited

U.S. PATENT DOCUMENTS

2004/0150694 A1* 8/2004 Kim et al. ..... 347/54
2009/0167820 A1* 7/2009 Kato et al. ..... 347/65

FOREIGN PATENT DOCUMENTS

JP 09-131891 5/1997

OTHER PUBLICATIONS

English translation of JP-09-131891, May 20, 1997.
English Abstract of JP-09-131891, May 20, 1997.

* cited by examiner

*Primary Examiner* — Laura Martin
(74) *Attorney, Agent, or Firm* — Staas & Halsey LLP

(57) ABSTRACT

Disclosed is a thermal inkjet printhead including at least one volume-changing body that can be used to maintain a flow resistance of ink that flows into an ink chamber substantially constant over an operating temperature range for the thermal inkjet printhead. The volume-changing body can be disposed in the ink flow path through which ink flows into the ink chamber and can be configured to adjust its volume to change the cross-sectional area of the ink flow path when the operating temperature of the thermal inkjet printhead, and thus the viscosity of the ink, changes.

21 Claims, 9 Drawing Sheets

INKJET PRINTHEAD

CROSS-REFERENCE TO RELATED PATENT APPLICATION

This application claims the benefit of Korean Patent Application No. 10-2008-0088946, filed on Sep. 9, 2008, in the Korean Intellectual Property Office, the disclosure of which is incorporated herein by reference in its entirety.

TECHNICAL FIELD

The present disclosure is generally related to a thermal inkjet printhead, and more particularly, to a thermal inject printhead that compensates for changes in ink viscosity that may result when the operating temperature changes.

BACKGROUND OF RELATED ART

Generally, an inkjet printhead is an apparatus that is used to produce or form an image, such as an image having predetermined colors, for example, by discharging or ejecting small ink droplets on image locations on a printing medium. Such an inkjet printhead can generally be classified as one of two types of inkjet printheads based on die discharging mechanism that is used to eject the ink droplets. A first type is a thermal inkjet printhead in which ink droplets are ejected by a tension or pressure that is produced from ink bubbles that are generated by a heating source. A second type is a piezoelectric inkjet printhead in which ink droplets are ejected by a pressure that is applied to the ink from the deformation of a piezoelectric material or element.

By way of an example, a mechanism for discharging or ejecting ink droplets in the thermal inkjet printhead is described in more detail below. When a pulse current flows through a heater, such as a heater made of resistive heating elements, for example, heat is produced by the heater and the ink that is adjacent to the heater can be heated up to about 300 Celsius (° C.) quite rapidly. When as a consequence the ink boils, ink bubbles are produced and as the ink bubbles expand they apply pressure to the ink that fills the ink chambers. As a result, the ink in the ink chamber that is near a nozzle is ejected in the form of ink droplets to a region outside of the ink chamber.

The thermal inkjet printhead can have a configuration or structure in which a nozzle layer and a chamber layer are stacked or disposed on a substrate, with the chamber layer being disposed on the substrate and the nozzle layer being disposed on the chamber layer. The substrate can support multiple heaters. The chamber layer can include multiple ink chambers and the nozzle layer can include multiple nozzles. Each of the ink chambers in the chamber layer can be configured to be filled with ink that is to be ejected for printing. Each of the nozzles in the nozzle layer can be configured to eject ink that is contained in an associated ink chamber. In thermal inkjet printheads, the ink's physical properties, such as viscosity, for example, can change when the operating temperature of the thermal inkjet printhead changes. Because of the change in the ink's physical properties caused by the changes in operating temperature, the uniformity with which ink droplets are ejected across the thermal inkjet printhead can deteriorate, causing the quality of the printed image to be less than desirable.

SUMMARY OF THE DISCLOSURE

According to one aspect of the various embodiments of the disclosure, there is provided a thermal inkjet printhead that includes an ink chamber, a nozzle, and a structure configured to change its volume. The thermal inkjet printhead ejects ink stored in the ink chamber through the nozzle. The structure allows the flow resistance of the ink flowing into the ink chamber to be maintained substantially constant over a range of temperature.

The structure can be configured to adjust the cross-sectional area of the ink flow path associated with an ink inlet of the ink chamber based on the temperature. The structure can be configured to increase its volume to reduce the cross-sectional area of the ink flow path when the temperature increases. The structure can be configured to increase its volume when a viscosity of the ink flowing through the ink inlet into the ink chamber decreases as the temperature increases.

The device can be disposed inside the ink inlet of the ink chamber and can have a height that is substantially the same as the height of the ink chamber. The structure can be disposed inside the ink inlet of the ink chamber and can have a height that is lower than the height of the ink chamber. The device can include a temperature-sensitive hydrogel.

According to another aspect of the various embodiments of the disclosure, there is provided an inkjet printhead including a substrate, a chamber layer, at least one device, and a nozzle layer. The chamber layer can be disposed above the substrate and can include an ink chamber and an ink inlet. The ink chamber may be configured to receive ink through the ink inlet, which defines the ink flow path through which the ink flows into the ink chamber. The at least one device can be disposed within the ink inlet and can be configured to maintain substantially constant the flow resistance of the ink that flows into the ink chamber through the ink inlet by changing the volume of the device based on a change in the operating temperature of the inkjet printhead. The nozzle layer can be disposed above the chamber layer and can have a nozzle through which ink from the ink chamber is ejected.

The device can be configured to adjust the cross-sectional area of the ink flow path associated with the ink inlet based on the temperature of the ink. The device can be configured to increase its volume to adjust the cross-sectional area of the ink flow path associated with the ink inlet when the temperature of the ink increases. The device can be configured to increase its volume when a viscosity of the ink flowing through the ink inlet into the ink chamber decreases as the temperature of the ink increases.

The device can have a height that is substantially the same as the height of the ink chamber. The device can be configured to reduce the cross-sectional area of the ink flow path associated with the ink inlet by expanding in a lateral direction when the temperature of the ink increases. The device can have a substantially cylindrical shape. The device can have a height that is lower than the height of the inks chamber.

The device can be disposed on a bottom surface of the ink inlet. The device can reduce the cross-sectional area of the flow path associated with the ink inlet by concurrently expanding in the upward direction and in the lateral direction when the temperature of the ink increases. The device can include a temperature-sensitive hydrogel.

The inkjet printhead can further include a heater disposed within the ink chamber and configured to heat ink in the ink chamber to produce ink bubbles.

BRIEF DESCRIPTION OF THE DRAWINGS

Various aspects of the present disclosure will become more apparent and more readily appreciated from the following description of the embodiments, taken in conjunction with the accompanying drawings, in which.

DETAILED DESCRIPTION OF SEVERAL EMBODIMENTS

Figure 1:
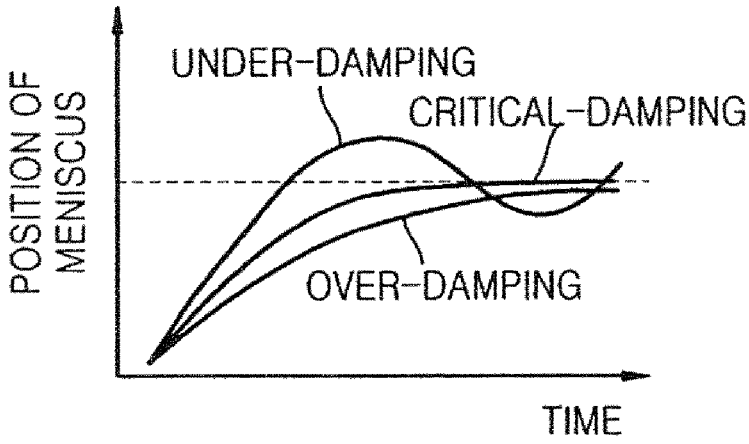
FIG. 1 is a showing positions of a meniscus as a function of time, in a conventional thermal inkjet printhead.

Several embodiments will now be described more fully with reference to the accompanying drawings. In the drawings, like reference numerals denote like elements, and the sizes and thicknesses of layers and regions may be exaggerated for clarity. The various embodiments described can have many different forms and should not be construed as being limited to the embodiments specifically set forth herein. It will also be understood that when a layer is referred to as being "on" another layer or substrate, the layer can be disposed directly on the other layer or substrate, or there could be intervening layers between the layer and the other layers or substrate.

Generally, high-speed printing requires that a conventional thermal inkjet printhead be operated at a high frequency, which also requires that each ink chamber be refilled with ink very quickly. In some instances, to provide such a quick refill of the ink chamber, a flow resistance associated with ink flowing through an ink inlet of the ink chamber may need to be reduced to increase the inflow speed of the ink as it flows into the ink chamber. When the inflow speed is too high, however, a meniscus of ink that typically occurs at an outlet of a nozzle associated with the ink chamber is vibrated by an inertial force, as illustrated in FIG. 1. In this instance, the vibration or oscillation of the meniscus is under-damped. Such under-damped vibration affects the size and/or the speed of the ejected ink droplets, which can lead to deterioration in the ejection uniformity of the inkjet printhead. In addition, the frequency with which the ink droplets can be ejected decreases because of the increased time that is required to stabilize the meniscus.

When the inflow speed of the ink that is flowing into the ink chamber is too slow, the meniscus at the outlet of the nozzle vibrates or oscillates in an over-damped manner. Such an over-damped vibration also deteriorates the ejection frequency performance because of the increased time that is required to stabilize the meniscus. Thus, a thermal inkjet printhead may need to be made in such a way that a meniscus of ink at the outlet of a nozzle is critically-damped. Such critically-damped vibration can provide an optimized inflow speed of the ink that is flowing into the ink chamber such that high-speed printing can be achieved.

Figure 2:
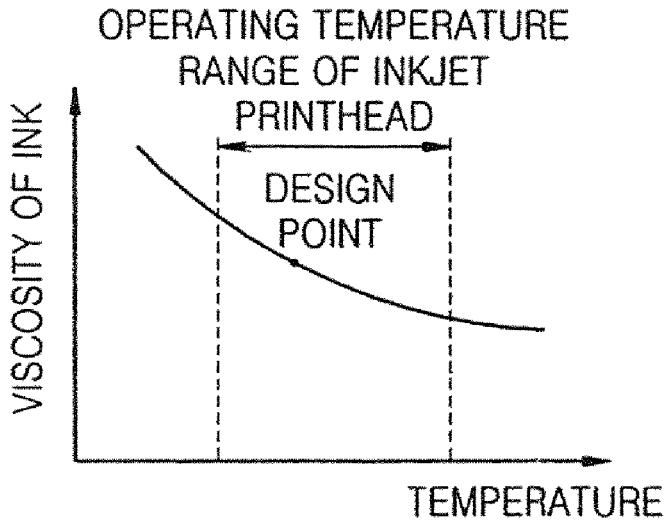
FIG. 2 is a graph showing the viscosity of ink as a function of temperature.

A thermal inkjet printhead typically operates in a temperature range from near room temperature, for example, about 20° C., to about 70° C. Within such a temperature range, certain physical properties of the ink used in the inkjet printhead, such as viscosity, for example, tend to change as the operating temperature changes. FIG. 2 shows a graph that illustrates changes in the viscosity of ink as a function of temperature. Referring to FIG. 2, when the operating temperature increases within the typical range of temperatures for an inkjet printhead, the viscosity of the ink decreases.

Figure 3:
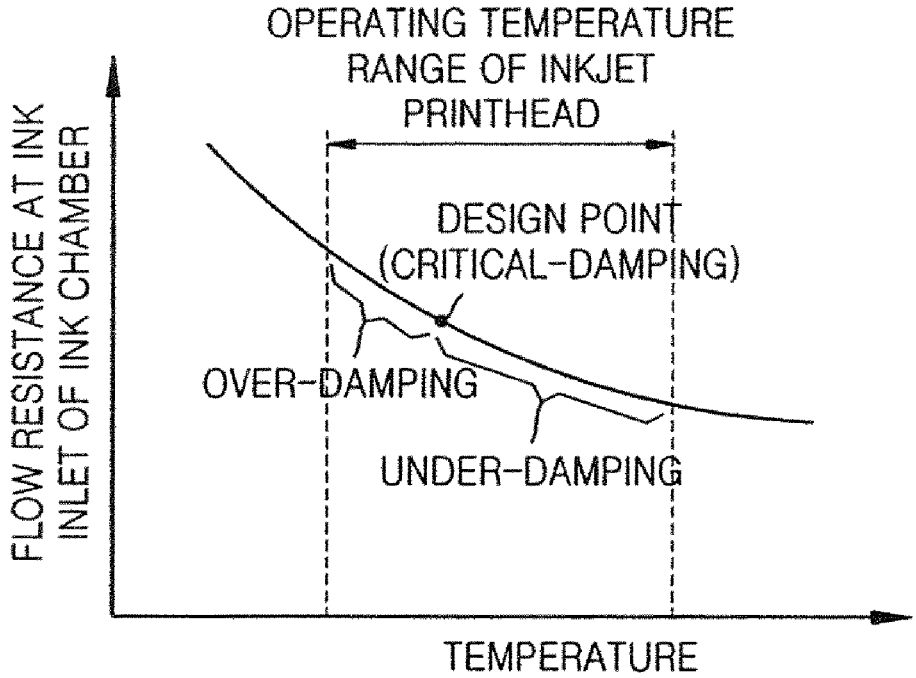
FIG. 3 is a graph showing flow resistance at an ink inlet of an ink chamber as a function of temperature in a conventional thermal inkjet printhead.

FIG. 3 is a graph that shows the flow resistance behavior of ink at an ink inlet of an ink chamber as a function of temperature in a conventional thermal inkjet printhead. Referring to FIG. 3, as the operating temperature increases within the typical temperature range of a typical thermal inkjet printhead, the flow resistance of ink at the ink inlet of the ink chamber decreases. Such decrease in the ink's flow resistance occurs because of a decrease in the viscosity of the ink as the operating temperature increases. FIG. 3 also shows a typical thermal inkjet printhead being designed in such a manner that a meniscus of ink at the outlet of the nozzle is critically-damped at certain temperatures when the ink chambers are being refilled with ink. In such a thermal inkjet printhead, however, the uniformity that can be achieved when ejecting ink droplets deteriorates as the operating temperature changes from the temperature or temperatures associated with the design-point described above. For example, when the thermal inkjet printhead operates at a higher temperature than the temperature or temperatures at which the meniscus is designed to be critically-damped, the viscosity of the ink decreases and the flow resistance of the ink that flows into an ink chamber decreases causing the meniscus to vibrate in an under-damped manner while the ink chamber is being refilled. When the thermal inkjet printhead operates at a lower temperature lower than the temperature or temperatures at which the meniscus is designed to be critically-damped, the viscosity of the ink increases and the flow resistance of the ink at the ink inlet of the ink chamber increases causing the meniscus to vibrate in an over-damped manner while the chamber is being refilled.

Generally, the flow resistance behaviors of a fluid, such as ink, for example, when passing through a stream or flow path that has a predetermined sectional form (e.g., size, shape) can be described by the expression in Equation 1 below:

$$R = \mu \int \frac{G dx}{A^2}, \qquad \text{(Equation 1)}$$

In Equation 1, R represents the flow resistance, μ represents the viscosity of the fluid, A represents a cross-sectional area of the flow path, G represents a function of the sectional form of the flow path, and x represents a coordinate of the flow path in a longitudinal direction (e.g., the direction of the fluid flow).

Referring to Equation 1, the flow resistance (R) is proportional to the viscosity (μ) of the fluid and is in inversely proportional to the square of the cross-sectional area of the flow path ($A^2$). Thus, by controlling the cross-sectional area of the flow path based on the changes to the fluid's viscosity that result from changes in operation temperature, it is possible to maintain the flow resistance substantially constant or uniform throughout a wide range of operating temperatures. For example, the viscosity of ink is typically about 2.1 centipose (cP) at 20° C., and is typically about 1.0 cP at 60° C., for example. When the viscosity decreases from 2.1 cP to 1.0 cP as the operating temperature increases from 20° C. to 60° C., the flow resistance can be maintained substantially constant over that temperature range by decreasing the cross-sectional area of the flow path by about 31%, for example.

The inkjet printhead according to an embodiment is configured to maintain the flow resistance of ink flowing into an ink chamber substantially constant by adjusting a cross-sectional area of a flow path associated with an ink inlet of the ink chamber. The cross-sectional area of the flow path can be adjusted by using a structure or device that is configured to change its volume. As a result, the meniscus of ink that forms at the ink outlet of the nozzle can be maintained critically-damped when ink is being refilled into the ink chamber at a temperature that is within the typical operating temperature range of the inkjet printhead.

Figure 4:
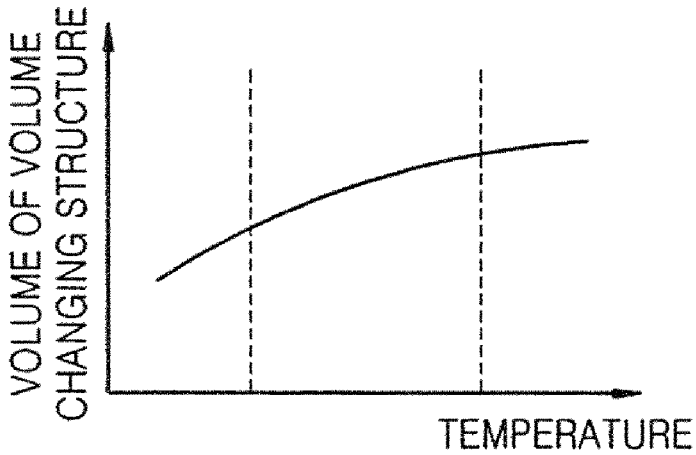
FIG. 4 is a graph showing volume of a volume-changing device as a function of in a thermal inkjet printhead, according to an embodiment.

FIG. 4 is a graph that shows the volume of a volume-changing device positioned at an ink inlet of an ink chamber as a function of temperature in a thermal inkjet printhead, according to an embodiment. Referring to FIG. 4, the volume of the volume-changing device increases as the temperature is increased. When the volume of the volume-changing device increases, a cross-sectional area of the flow path of the ink chamber inlet is reduced. Generally the cross-sectional area of the flow path refers to an area through which the ink passes to enter the ink chamber when the ink chamber is being refilled. The cross-sectional area of the flow path can be associated with an area that is substantially perpendicular to the direction in which the ink flows when entering the ink chamber. When an operating temperature of the thermal inkjet printhead increases, the viscosity of the ink decreases and the volume of the volume-changing device can be increased to compensate for the decrease in the viscosity of the ink. The volume-changing-device can be made of a material that can change its volume in a manner that compensates for the change in the viscosity of the ink when the operating temperature of the thermal inkjet printhead changes. By changing its volume, the volume-changing device can maintain the flow resistance of the ink at the ink chamber inlet substantially constant. The volume-changing device can include a temperature-sensitive hydrogel, for example. Such a material is capable of changing its volume in a desirable and known manner within the operating temperature range of the thermal inkjet printhead.

Figure 5:
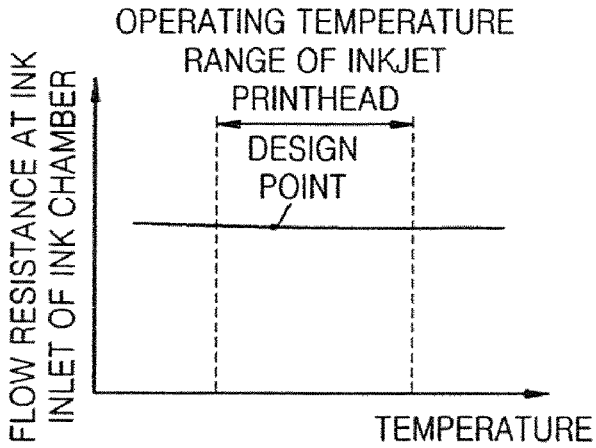
FIG. 5 is a graph showing flow resistance at an ink inlet of an ink chamber as a function of temperature in a thermal inkjet printhead, according to an embodiment.

As described above, the volume of the volume-changing device changes to offset the changes in the viscosity of the ink when the operating temperature changes. FIG. 5 illustrates by changing the volume in the volume-changing device, the flow resistance of the ink that flows into the ink chamber can be maintained substantially constant over the typical range of operating temperatures of the thermal inkjet printhead.

Figure 6A:
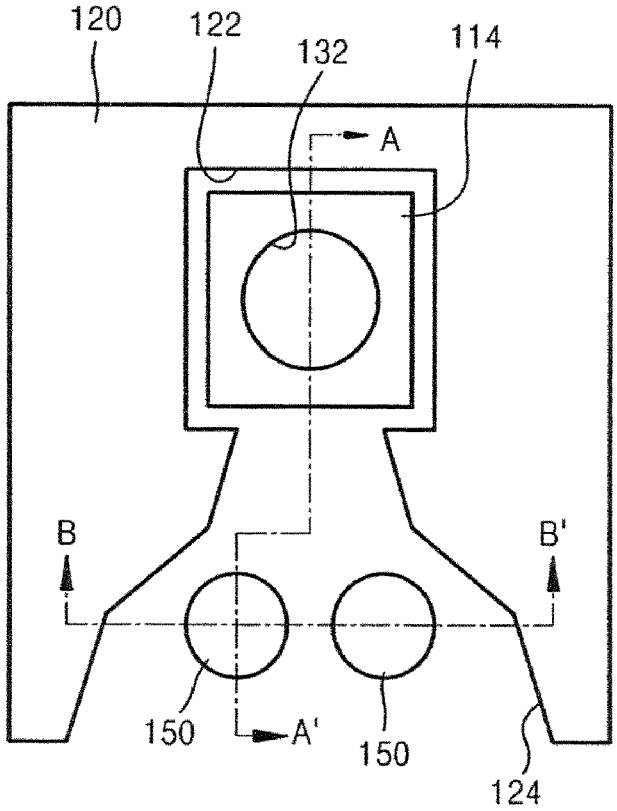
FIGS. 6A-7C are diagrams illustrating an inkjet printhead, according to an embodiment.
Figure 6B:
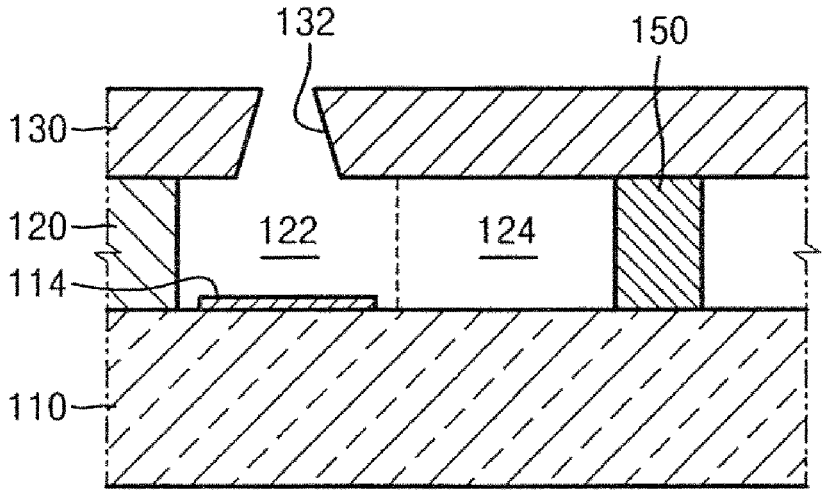
Figure 6C:
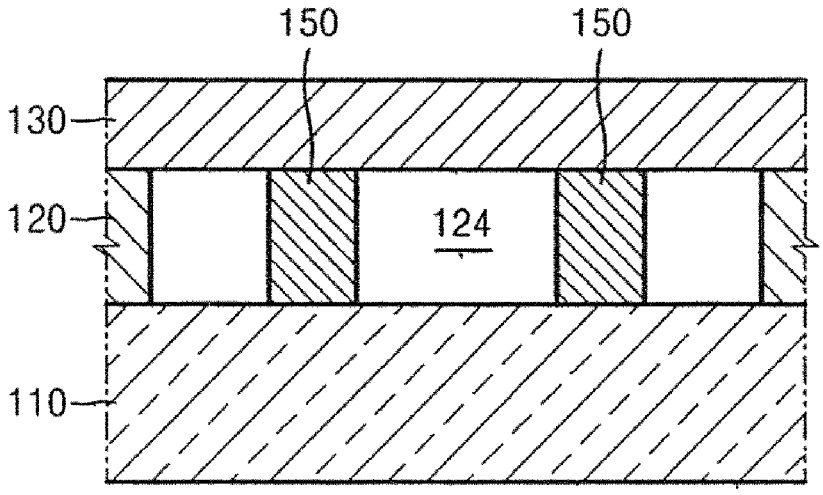
Figure 7A:
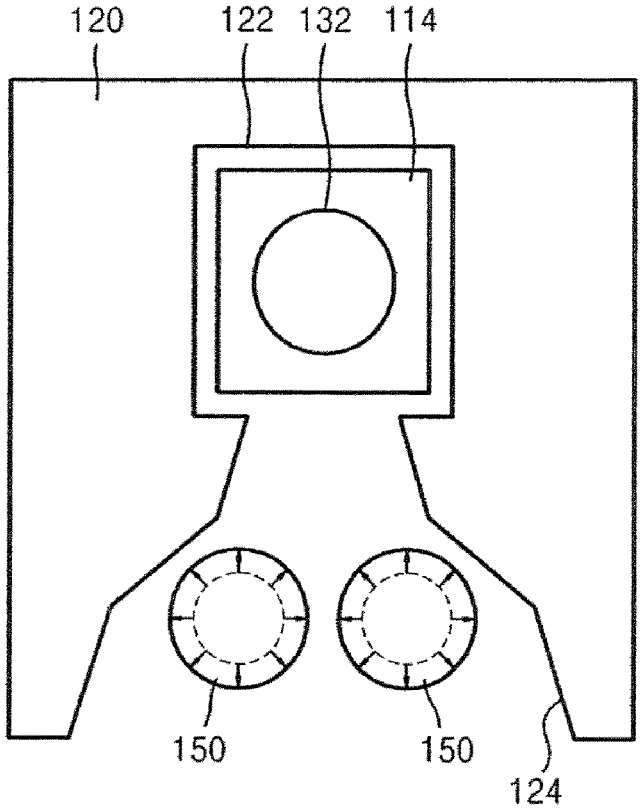
Figure 7B:
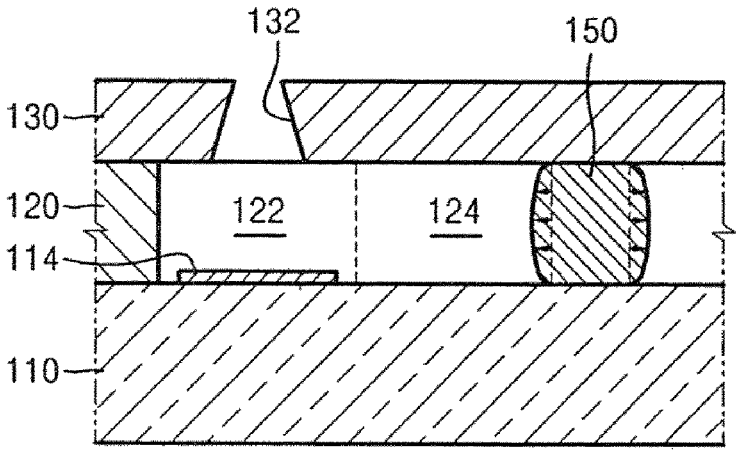
Figure 7C:
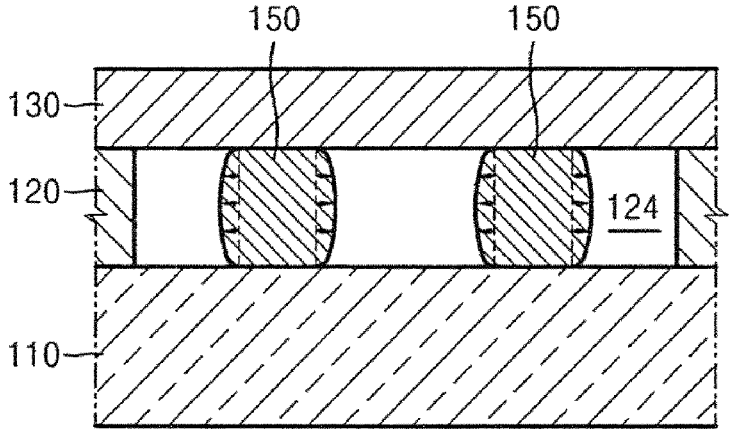

FIGS. 6A-7C are diagrams illustrating an inkjet printhead, according to an embodiment. FIG. 6A is a plan view and FIGS. 6B and 6C are cross-sectional views, each of which illustrates the inkjet printhead operating at a predetermined temperature such as, for example, room temperature. FIG. 6B is a cross-sectional view taken along A-A' of FIG. 6A, and FIG. 6C is a cross-sectional view taken along B-B' of FIG. 6A. Also, FIG. 7A is a plan view and FIGS. 7B and 7C are cross-sectional views, each of which illustrates the inkjet printhead operating at a temperature that is higher than the temperature of FIGS. 6A-6C, such as, for example, a temperature higher than room temperature.

Referring to FIGS. 6A-6C, a chamber layer 120 is disposed on a substrate 110 and a nozzle layer 130 is disposed on the chamber layer 120. The substrate 110 can be a silicon substrate, for example, but need not be so limited. The chamber layer 120 can include an ink chamber 122 and an ink inlet 124 associated with the ink chamber 122. The ink chamber 122 is configured to hold or store ink that is to be ejected from the ink chamber 122. The ink chamber 122 includes a heater 114 that is configured to heat the ink stored within the ink chamber to produce ink bubbles. The heater 114 can be disposed on a bottom surface of the ink chamber 122 and above the substrate 110. The ink inlet 124 is a path through which the ink flows into the ink chamber 122. The substrate 110 can also include an ink feed hole (not shown) for supplying the ink to the ink chamber 122. The nozzle layer 130 includes a nozzle 112 positioned substantially above the ink-chamber 122 and through which the ink in the ink chamber 122 is ejected.

In one embodiment, a volume-changing device 150 can be disposed within the ink inlet 124 and can be configured to have a height that is substantially the same as the height of the chamber layer 120. The volume-changing device 150 can be configured to have a predetermined volume at room temperature, for example. The volume-changing device 150 can be made of a material having such properties that allow the material to increase its volume when the operating temperature increases and the operating temperature is within the typical temperature range of the inkjet printhead. Moreover, the volume-changing device 150 can be made of a material that can change its volume to compensate for the change in the viscosity of the ink such that the flow resistance of the ink flowing into the ink chamber remains substantially constant as a function of temperature. Thus, the volume-changing device 150 maintains the flow resistance of the ink at the ink inlet 124 substantially constant by increasing its volume when the operating temperature of the inkjet printhead increases.

The volume-changing device 150 can be made of, for example, a temperature-sensitive hydrogel. The temperature-sensitive hydrogel includes a polymer network that can change its volume as the operating temperature increases within a temperature range from about room temperature to about 70° C. The volume-changing device 150 described in FIGS. 6A-6C can have a substantially cylindrical shape, for example. The shape of the volume-changing device 150, however, need not be so limited. Moreover, FIGS. 6A-6C disclose using two volume-changing devices 150 to maintain a constant flow resistance at the ink inlet 124. The number of volume-changing devices 150, however, need not be so limited. Fewer or more volume-changing devices 150 can be used than disclosed in the exemplary embodiments described in FIGS. 6A-6C.

Referring to FIGS. 7A-7C, when the operating temperature of the inkjet printhead increases to a temperature that is higher than room temperature, the ink viscosity decreases and the volume of each of the volume-changing devices 150 is increased. The increase in volume of the volume-changing devices 150 compensates for the decrease in ink viscosity that results from the increase in operating temperature. By increasing the volume of the volume-changing devices 150, the cross-sectional area of the flow path of the ink inlet 124 is decreased. The cross-sectional area of the flow path of the ink inlet 124 refers to an area through which the ink flows or passes in the ink inlet 124. The cross-sectional area of the flow path of the ink inlet 124 can refer to an area that is substantially perpendicular to the direction in which the ink flows when the ink chamber 122 is being filled with ink.

In the current embodiment, because the volume-changing device 150 has the same height as the chamber layer 120, the volume-changing device 150 expands or increases its volume in a lateral or radial direction when the operating temperature increases. The decrease in ink viscosity resulting from the increase in operating temperature can reduce the flow resistance of the ink that flows into the ink chamber 122. Thus, by expanding or increasing the volume of the volume-changing device 150 as the operating temperature increases, the cross-sectional area of the flow path of the ink inlet 124 is reduced and the flow resistance of the ink that flows into the ink chamber 122 is increased. The decrease in the flow resistance that results from the decrease in ink viscosity is offset by the increase in the flow resistance that results from the expansion of the volume-changing device 150. Therefore, when the ink temperature changes with the changes in operating temperature of the inkjet printhead and the ink temperature is within the typical operating temperature range of the inkjet printhead, the volume of the volume-changing device 150 is adjusted such that the flow resistance of the ink that flows into the ink chamber 122 remains substantially constant over the typical operating temperature range of the inkjet printhead. As a result of maintaining the flow resistance substantially constant, the meniscus of ink that forms at the outlet of the nozzle 132 is maintained critically-damped when refilling the ink chamber 122. Such results produce improved ejection uniformity of the inkjet printhead and also allow for high-speed printing because the shorter time that is required when refilling the ink chamber 122 supports a higher frequency of operation.

Figure 8A:
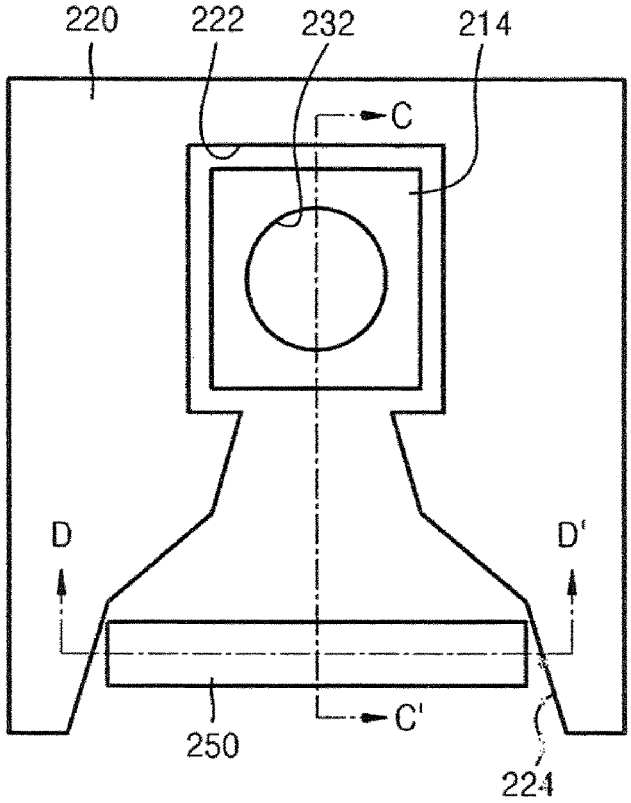
FIGS. 8A-9C are diagrams illustrating an inkjet printhead, according to another embodiment.
Figure 8B:
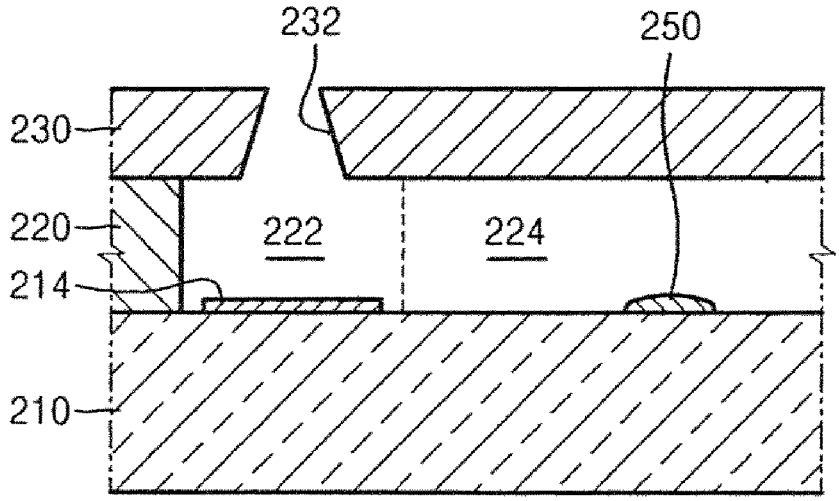
Figure 8C:
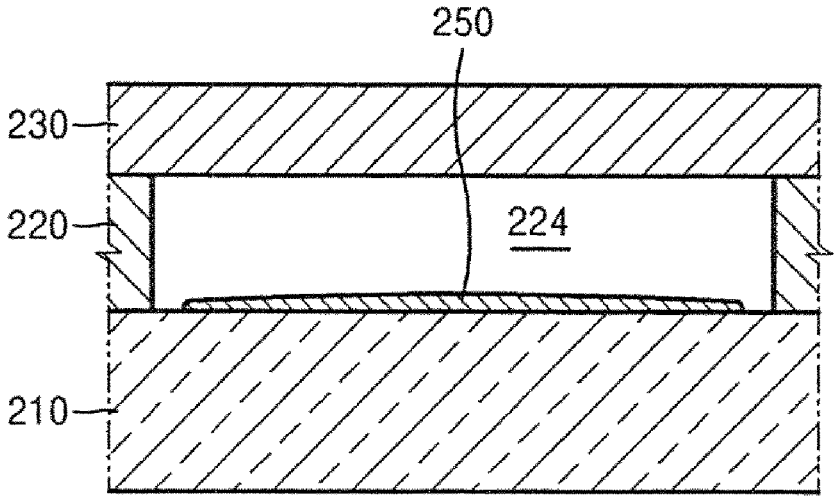
Figure 9A:
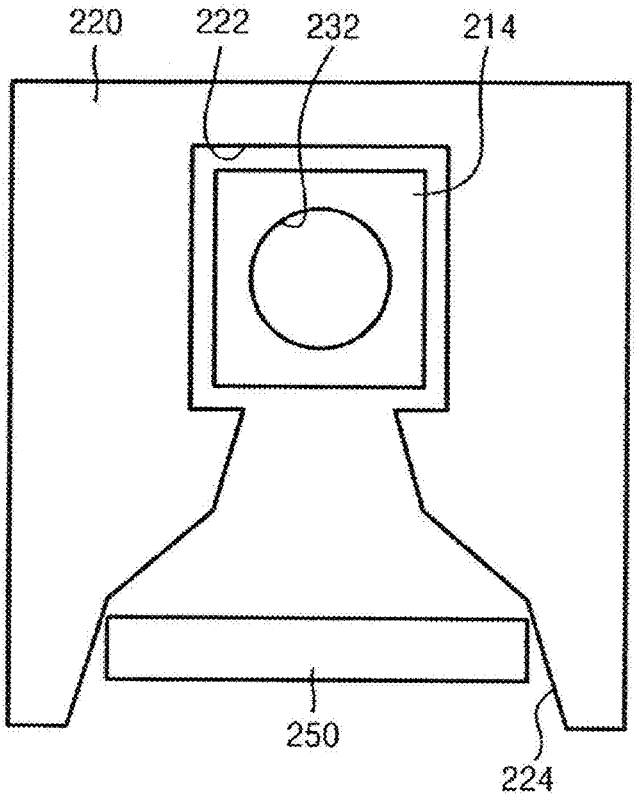
Figure 9B:
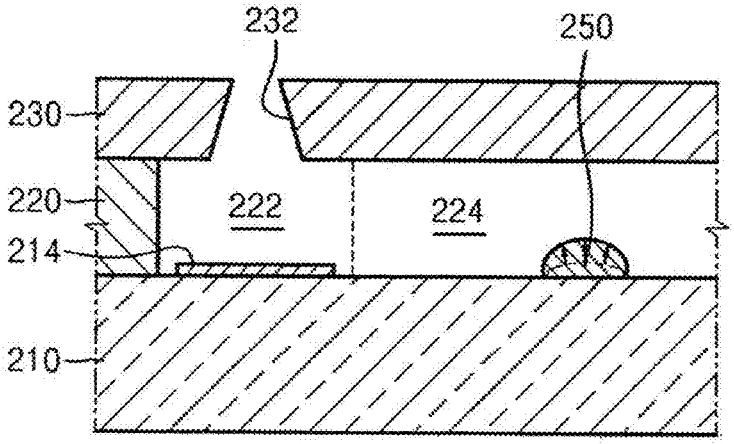
Figure 9C:
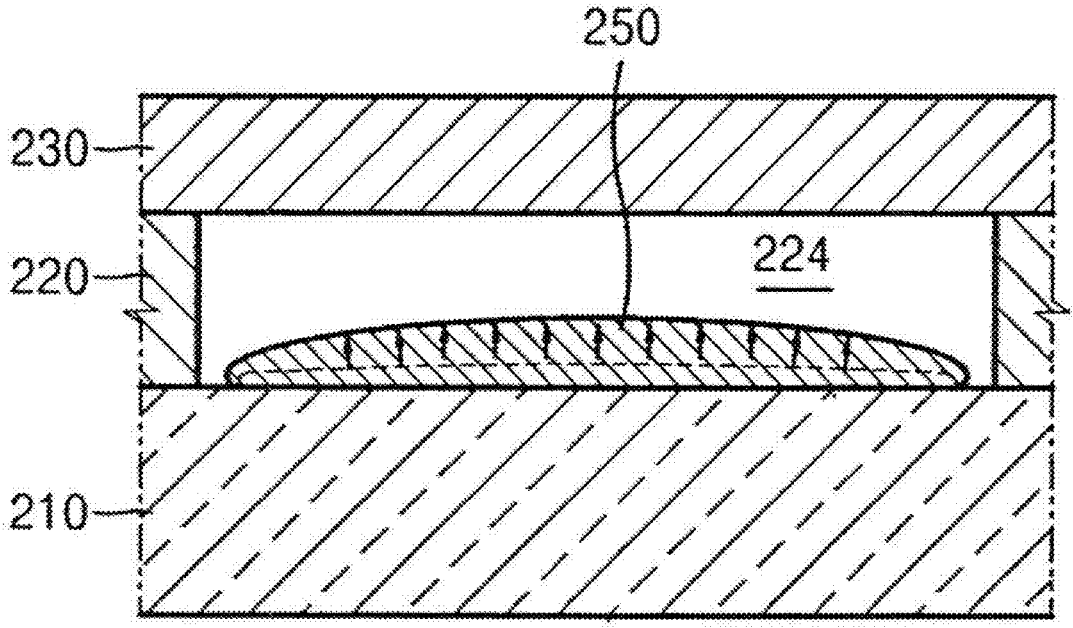

FIGS. 8A-9C are diagrams illustrating an inkjet printhead according to another embodiment. FIG. 8A is a plan view and FIGS. 8B and 8C are cross-sectional views, each of which illustrates an inkjet printhead operating at a predetermined temperature, such as room temperature, for example. FIG. 8B is a cross sectional view taken along C-C' of FIG. 8A, and FIG. 8C is a cross sectional view taken along D-D' of FIG. 8A. Also, FIG. 9A is a plan view and FIGS. 9B and 9C are cross sectional views, each of which illustrates the inkjet printhead operating at a temperature higher than that of FIGS. 8A-8C, such as, for example, a temperature higher than room temperature.

Referring to FIGS. 8A-8C, a chamber layer 220 is disposed on a substrate 210 and a nozzle layer 230 is disposed on the chamber layer 220. The chamber layer 220 can include an ink chamber 222 that is configured to be filled with ink to be ejected from the inkjet printhead. The chamber layer 220 can also include an ink inlet 224 that is configured as a path for the ink to flow into the ink chamber 222. The ink chamber 222 can further include a heater 214 that is configured to heat the ink in the ink chamber 222 to produce ink bubbles. The nozzle layer 230 can include a nozzle 232 through which ink from the ink chamber 220 is ejected during the printing process.

A volume-changing device 250 can be disposed within the ink inlet 224. The volume-changing device 250 can be configured to have a height that is lower than the height of the chamber layer 220. The volume-changing device 250 can be of any one of multiple shapes. The volume-changing device 250 can be disposed on a bottom surface of the ink inlet 224. The placement of the volume-changing device 250, however, need not be so limited.

The volume-changing device 250 can be configured to have a predetermined volume at room temperature. The volume-changing device 250 can be made of a material having such properties that allow the material to increase its volume when the operating temperature of the inkjet printhead increases and is within the typical temperature range for the inkjet printhead. Moreover, the volume-changing device 250 can be made of a material that can change its volume to compensate for the change in the viscosity of the ink that results when the temperature changes such that the flow resistance of ink flowing into the ink chamber 222 remains substantially constant as a function of temperature. As described above, the volume-changing device 250 can be made of a temperature-sensitive hydrogel, for example. The embodiments described with respect to FIGS. 8A-8C show a single volume-changing device 250, however, in other embodiments, a larger number of volume-changing devices 250 can be used.

Referring to FIGS. 9A-9C, when the operating temperature of the inkjet printhead increases to a temperature that is higher than room temperature, the viscosity of the ink decreases and the volume of the volume-changing device 250 is increased. The increase in the volume of the volume-changing device 250 compensates for the decrease of the viscosity of the ink that results from the increase in the operating temperature. In the embodiments in which the volume-changing device 250 is disposed on the bottom surface of the ink inlet 224, the volume-changing device 250 can expand or increase its volume in the upward direction and/or the lateral direction. Thus, as the volume of the volume-changing device 250 increases, a cross-sectional area of a flow path of the ink inlet 224 decreases. In the current embodiment, the decrease in the flow resistance that results from the decrease in the viscosity of the ink can be offset by an increase in the flow resistance that results from the expansion of the volume-changing device 250. Therefore, when the ink temperature changes as the operating temperature of the inkjet printhead changes and is within the typical operating temperature range of the inkjet printhead, the flow resistance can be maintained substantially constant and the meniscus of ink that forms at the outlet of the nozzle 232 vibrates in a critically-damped manner while the ink chamber 220 is being refilled.

According to the embodiments described above, the flow resistance at the ink inlet of the ink chamber is maintained substantially constant within the operating temperature range of the inkjet printhhead such that the refill and/or ejection behavior of the ink remains substantially stable during operation of the inkjet printhead. Moreover, the ejection frequency of the inkjet printhead can be improved to allow high-speed printing.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A thermal inkjet printhead for ejecting ink from an ink chamber through a nozzle, comprising:

an ink inlet defining an ink flow path through which ink flows into the ink chamber; and at least one structure formed of a material that changes its volume in response to a change in temperature, the at least one structure being arranged in the thermal inkjet printhead so as to maintain a flow resistance of the ink flowing into the ink chamber substantially constant over a range of temperature.

2. The thermal inkjet printhead of claim 1, wherein the at least one structure is configured to adjust a cross-sectional area of the ink flow path associated with the ink inlet based on the change in the temperature.

3. The thermal inkjet printhead of claim 2, wherein the at least one structure is configured to increase its volume to adjust the cross-sectional area of the ink flow path associated with the ink inlet of the ink chamber when the temperature increases.

4. The thermal inkjet printhead of claim 2, wherein the at least one structure is configured to increase its volume when a viscosity of the ink flowing through the ink inlet into the ink chamber decreases as the temperature increases.

5. The thermal inkjet printhead of claim 1, wherein the at least one structure is disposed inside the ink inlet, and has a height that is substantially the same as a height of the ink chamber.

6. The thermal inkjet printhead of claim 1, wherein the at least one structure is disposed inside the ink inlet of the ink chamber and has a height that is lower than a height of the ink chamber.

7. The thermal inkjet printhead of claim 1, wherein the at least one structure comprises a temperature-sensitive hydrogel.

8. An inkjet printhead, comprising:

a substrate;

a chamber layer disposed above the substrate, the chamber layer including an ink chamber and an ink inlet, the ink chamber being configured to receive ink through the ink inlet, the ink inlet defining an ink flow path through which ink flows into the ink chamber;

at least one structure disposed within the ink inlet, the at least one structure being made of a material that changes its volume in response to a change in temperature so as to maintain a flow resistance of the ink that flows into the ink chamber through the ink inlet substantially constant; and a nozzle layer disposed above the chamber layer, the nozzle layer having a nozzle through which ink from the ink chamber is ejected.

9. The inkjet printhead of claim 8, wherein the at least one structure is configured to adjust a cross-sectional area of the ink flow path associated with the ink inlet based on the change in the temperature.

10. The inkjet printhead of claim 9, wherein the at least one structure is configured to increase its volume to adjust the cross-sectional area of the ink flow path associated with the ink inlet when the temperature increases.

11. The inkjet printhead of claim 9, wherein the at least one structure is configured to increase its volume when a viscosity of the ink flowing through the ink inlet into the ink chamber decreases as the temperature increases.

12. The inkjet printhead of claim 8, wherein the at least one structure has a height that is substantially the same as a height of the ink chamber.

13. The inkjet printhead of claim 12, wherein the at least one structure is configured to reduce the cross-sectional area of the ink flow path associated with the ink inlet by expanding in a lateral direction when the temperature increases.

14. The inkjet printhead of claim 12, wherein the at least one structure has a substantially cylindrical shape.

15. The inkjet printhead of claim 8, wherein the at least one structure has a height that is lower than a height of the ink chamber.

16. The inkjet printhead of claim 15, wherein the at least one structure is disposed on a bottom surface of the ink inlet.

17. The inkjet printhead of claim 16, wherein the at least one structure reduces the cross-sectional area of the flow path associated with the ink inlet by concurrently expanding in an upper direction and in a lateral direction when the temperature increases.

18. The inkjet printhead of claim 8, wherein the at least one structure comprises a temperature-sensitive hydrogel.

19. The inkjet printhead of claim 8, further comprising a heater disposed within the ink chamber and configured to heat ink in the ink chamber to produce ink bubbles.

20. A thermal inkjet printhead for ejecting ink from an ink chamber through a nozzle, comprising:

an ink inlet defining an ink flow path through which ink flows into the ink chamber; and a body of a material having a positive coefficient of thermal expansion disposed in the ink inlet to adjust a size of the ink flow path by changing its volume in response to a change in temperature.

21. The thermal inkjet printhead of claim 20, wherein the material comprises a temperature-sensitive hydrogel that expands as the temperature increases to reduce a cross-sectional area of the ink flow path.

* * * * *